US006220428B1

(12) United States Patent
Lan

(10) Patent No.: US 6,220,428 B1
(45) Date of Patent: Apr. 24, 2001

(54) AUTOMATIC CIGARETTE LIGHTING CASE

(76) Inventor: Yung-Huei Lan, 3F., No. 32, Lane 61, Han-Chou S. Rd., Sec. 2, Taipei (TW)

( * ) Notice: Subject to any disclaimer, the term of this patent is extended or adjusted under 35 U.S.C. 154(b) by 0 days.

(21) Appl. No.: 08/327,006

(22) Filed: Oct. 24, 1994

(51) Int. Cl.[7] ..... B65D 85/10
(52) U.S. Cl. ..... 206/88
(58) Field of Search ..... 206/85, 86, 88, 206/242

(56) References Cited

U.S. PATENT DOCUMENTS 1,373,262 * 3/1921 Racz ..... 206/88 X
1,782,081 * 11/1930 Werner ..... 206/88 X
1,821,753 * 9/1931 Hovnan ..... 206/89
2,207,593 * 7/1940 Lorant ..... 206/88
2,216,166 * 10/1940 Fiscner ..... 206/249 X
2,856,098 * 10/1958 Geisel ..... 206/88 X
4,844,244 * 7/1989 Mawby ..... 206/88
5,265,717 * 11/1993 Daghestani ..... 206/88

* cited by examiner

*Primary Examiner*—Bryon P. Gehman
(74) *Attorney, Agent, or Firm*—Alfred Lei

(57) ABSTRACT

An automatic cigarette case which can be operated by one hand to pull out and light a cigarette from the case, includes a cigarette case, a turning device, a revolving device and a lighting device, characterized in that cigarettes are arranged inside the case, by rotating the turning device, a cigarette can be drawn out from the cigarette case. When the cigarette is being withdrawn, it revolves when it is in contact with the revolving device, placing the cigarette on top of the lighting device. The cigarette can then be lighted by the lighting device.

8 Claims, 15 Drawing Sheets

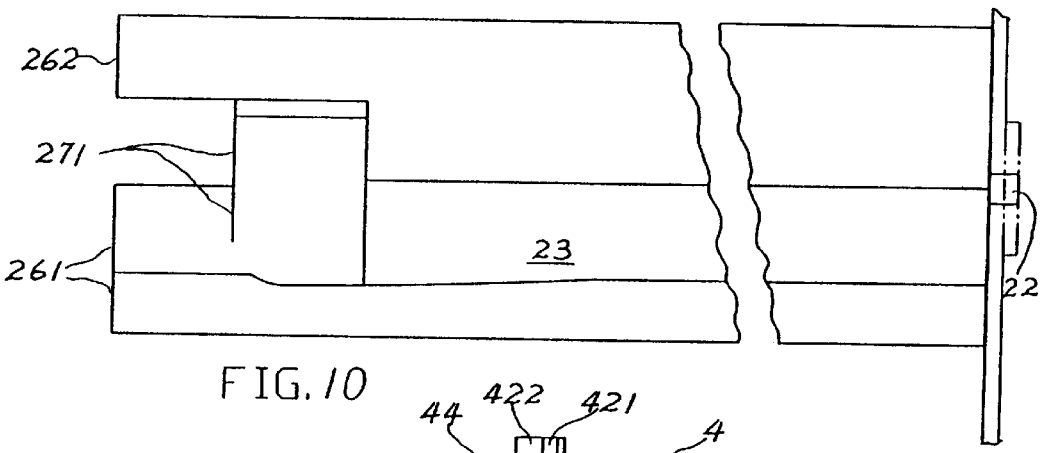
FIG. 10
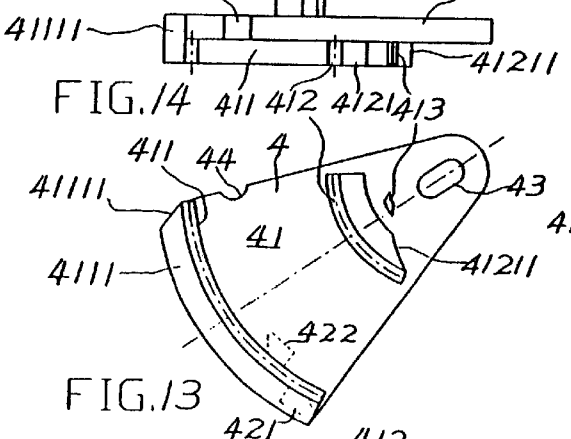
FIG. 14
FIG. 13
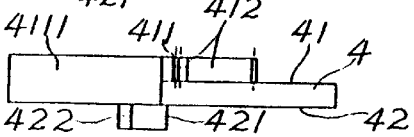
FIG. 15
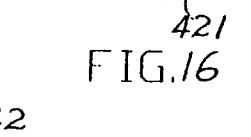
FIG. 16
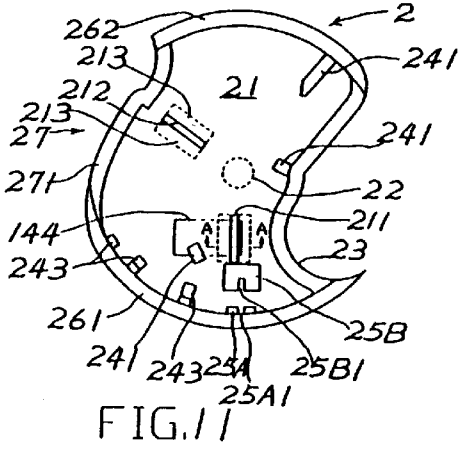
FIG. 11
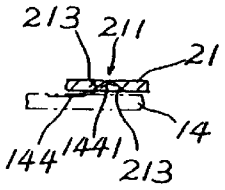
FIG. 12

321
331
32
33
34
322
31
732

311
511
51
52
521
522

18
2
328
452
45
32962
32961
3296
3297
32971
32963
32972
3
22
2242
23
224
2241
32
3293
329
32101
3210
32911
3291
(OR3292)
(OR32921)
3292
32942
3294
3295
32941

AUTOMATIC CIGARETTE LIGHTING CASE

BACKGROUND OF THE INVENTION

This invention relates to an automatic cigarette case which can be operated by one hand for withdrawing and lighting a cigarette. It mainly consists of a cigarette case which can hold a plurality of cigarettes, a turning device for handling the cigarette, a revolving device and a lighting device. In use, the cigarettes are first arranged in order inside the cigarette case. The turning device mainly consists of a turning drum. The drum is provided with a recess portion for holding one cigarette. The cigarette can be rotated from inside to outside of the case. The turning drum is provided with an axle in the axial direction. The axle is used for pivotally connecting to the case. The turning drum is located on the notch at the edge of the cigarette case, which is arranged in parallel with and touching the cigarettes inside the case. When the recess portion is rotated to the inside of the case, the cigarette inside the case may enter the recess portion. The revolving device is provided with a blocking member, which is located at one end of the turning drum (outside of the cigarette case). By rotating the turning drum and the blocking member, the cigarette inside the recess portion can be revolved. The lighting device is provided inside the turning drum at a location that is convenient to light the cigarette. In use, the recess portion of the turning drum is rotated inside of the cigarette case, (if it is already inside the case, this step is not required), allowing a cigarette to enter and stay inside the recess portion. The turning drum can then be turned, allowing the cigarette and the recess portion to rotate to outside of case. When the lighting end of the cigarette touches the blocking member, the turning drum continues to rotate, and the other end of the cigarette departs from the recess portion and sticks up. By appropriate design, the stick-up cigarette stays at the lighting position ready to be lighted.

For a more detail description, the cigarette case can be provided with a push plate which can be pushed by the resiliency of a spring. The push plate pushes the cigarette into the recess portion of the turning drum. Despite simplicity, without the push plate will require the cigarette case to be tilted in order to refill the cigarette into the case.

Since the turning drum is pivotally connected to the case, when the cigarette inside the recess portion sticks up in the lighting position, it must be stopped. Therefore, suitable stopping block is provided so that the turning drum can be stopped in the correct position.

For the convenience of sealing, the turning drum is also provided with a lid. Between the lid and the turning drum is provided with a suitable driving device. When the lid is open, the driving device will rotate the turning drum. This driving device can satisfy the rotational requirement of the turning drum. If the lid is closed, the recess portion stays outside of the cigarette case. When the lid is open, the recess portion will rotate inside the case to hold the cigarette and return back to the outside of case. If the lid is not open, and the recess portion stays outside of the case, then when the lid is open, the recess portion will rotate to the outside of the case. In addition, the requirement depends on the design when closing the lid; the driving device can either rotate the recess portion or maintain its position.

The revolving device consists of a blocking member and a cigarette holder, which is located at one end of the turning drum. When the recess portion is rotated, the holder can hold the cigarette firmly, and allows it to stay between the blocking member and the holder. (this is the suitable position for the turning drum to be stopped.)

The lighting device is merely a cigarette lighter. When the cigarette revolved reaches the correct position, a finger can start the lighter. For the convenience of one-hand operation, the lighting device is also provided with a starting device, a press arm and a push arm. The starting device is designed based on the structure of the lighter. For lighters that only require pressing, the starting device can be a keypad. The starting device can also be eliminated, instead, the press arm can start the lighter directly. For lighters that require the striking of the wheels (designated as component 62 in all the drawings), the starting device shall consists of the pushing member and the pressing member. The press arm is a movable arm, which can press or ignite the lighter. The driving device of the press arm is an appropriate driving device and is provided between the turning drum and the press arm. The rotation of the lid drives the press arm.

BRIEF DESCRIPTION OF THE DRAWINGS

FIG. 10 is a side elevation view of the turning drum 2; i.e., it is a right elevation view of FIG. 11.

FIG. 11 is an elevation view of the turning drum.

FIG. 12 is the A—A section of FIG. 11.

FIG. 13 is a front view of the sector gear slat; the pitch line of the sector gear slat is shown with the center line.

FIGS. 14 through 16 are respectively the top view, the bottom view an the right elevation view of FIG. 13.

FIG. 41 is another view of FIG. 40 with all the components in the turning drum, together with the bottom plate 21 and the right side portion of the cigarette case removed, so as to see the structure of the driving device; FIG. 42 shows a view of FIG. 41 in which lid 3 is wide open and cigarette 18 us being revolved.

FIG. 44 is another view of FIG. 43 with all the components in the turning drum, together with the bottom plate 21 and the right side portion of the cigarette case removed, so as to see the structure of the driving device; FIG. 45 shows a view of FIG. 44 in which lid 3 is wide open and cigarette 18 is being revolved.

FIGS. 46 through 48 shows the conditions of lid 3 which is completely closed, partially open and wide open respectively.

FIG. 54 shows the condition in which lid 3 is completely closed, FIG. 55 shows the condition in which lid 3 is slightly open, guide plate 32991 will prevent pin wheel from touching guide member 224 and the turning drum will not turn; FIG. 56 also shows the condition in which the lid is slightly open, the guide plate enables the pin wheel to drive the guide member and the turning drum so that a cigarette can be dispensed from the case; FIG. 57 shows the condition in which the lid is wide open.

DETAILED DESCRIPTION OF THE PREFERRED EMBODIMENT

Figure 1:
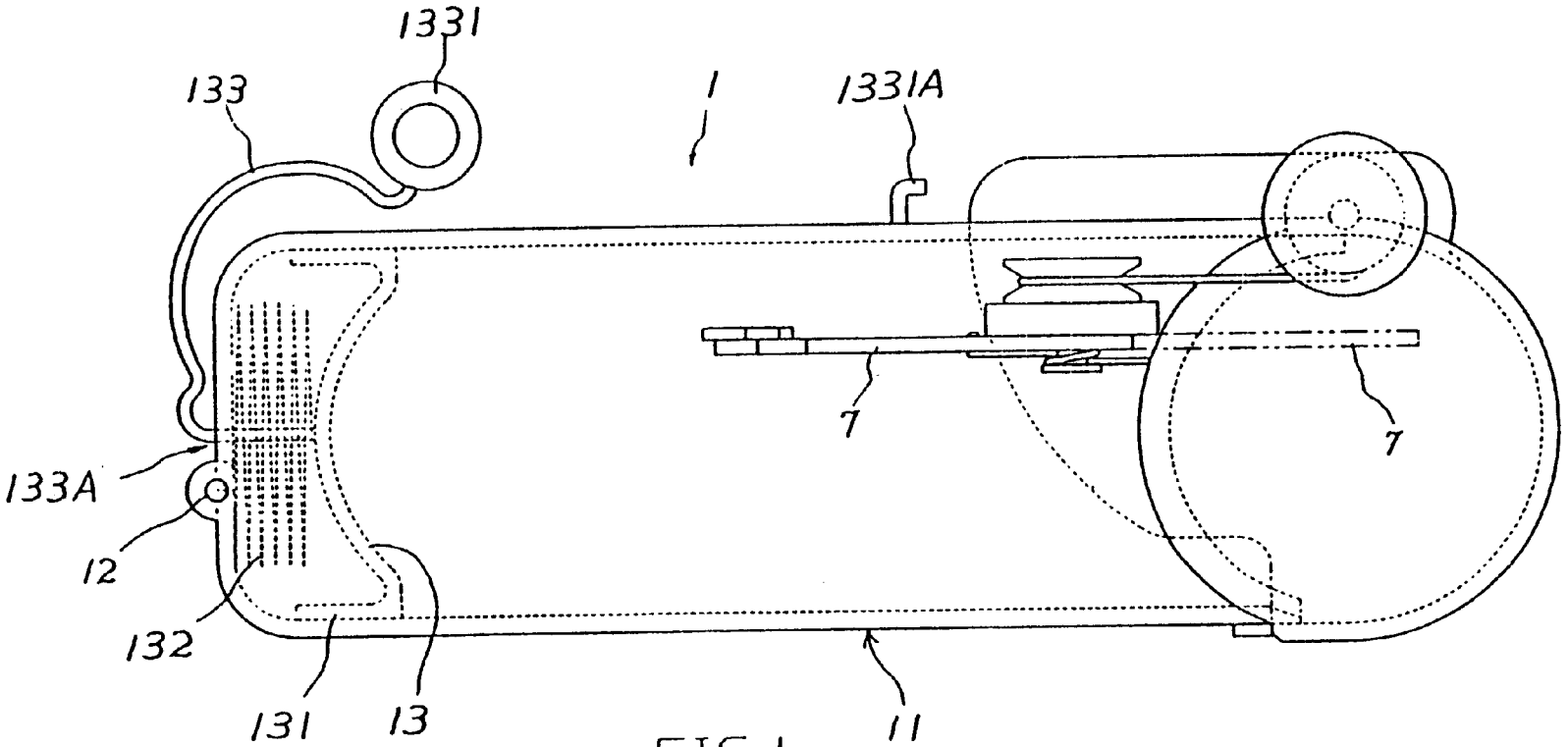
FIG. 1 is a front view according to the present invention.
Figure 9:
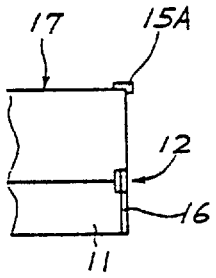
FIG. 9 is a left elevation view in which a majority of the components are remove.
Figure 5:
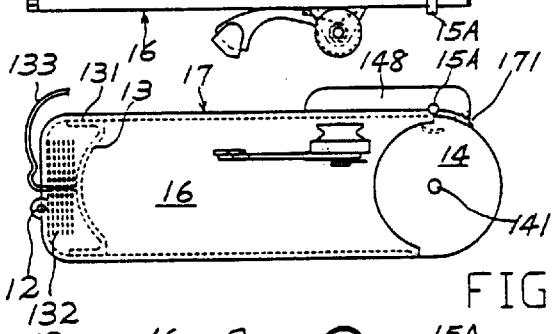
FIG. 5 is a front view of the automatic cigarette case 1.
Figure 8:
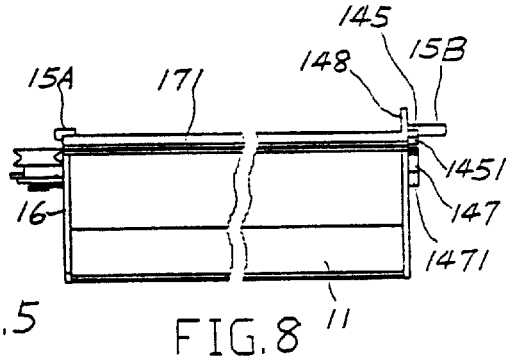
Figure 6:
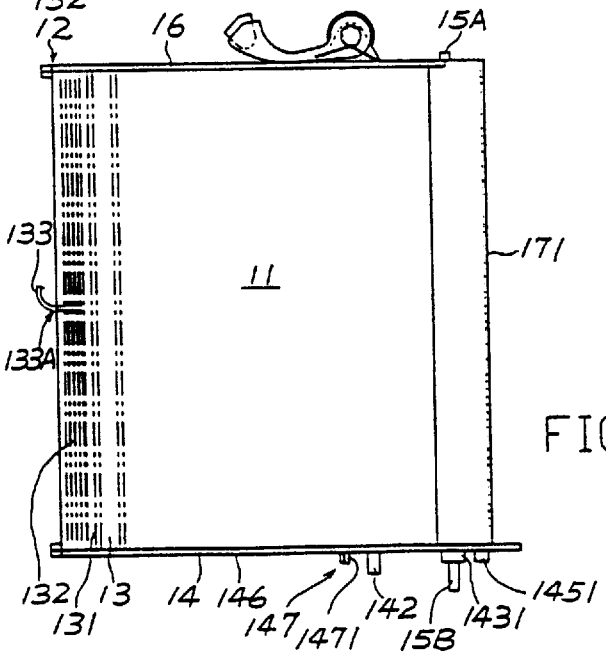
Figures 17, 18, 19, 20, 21, 22, 23, 24, 25, 26:
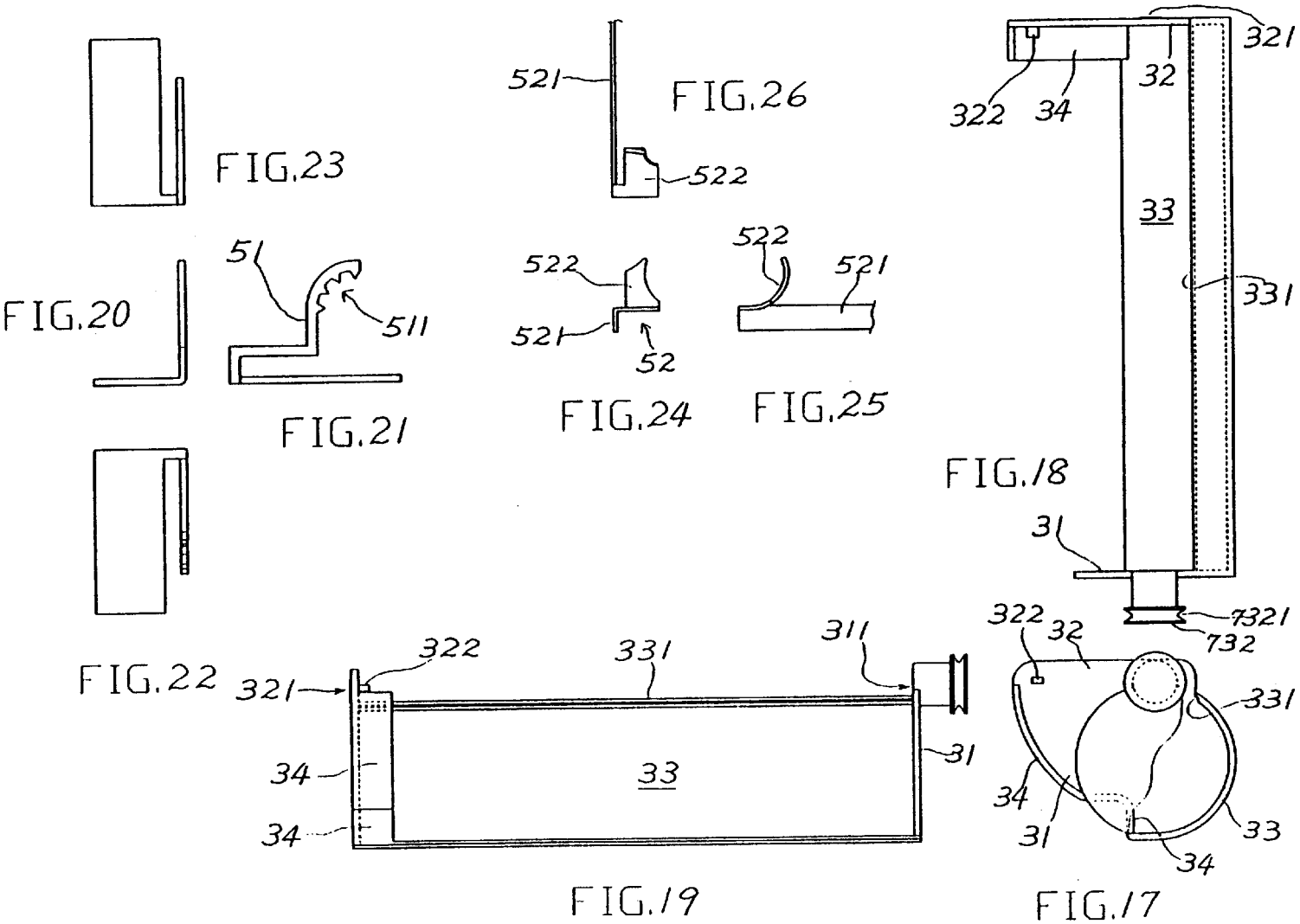
FIG. 17 shows a front view of lid 3 of the turning drum, however, in the following embodiments, there is a slight modification to the bottom side plate 32 of the lid when the driving device of turning drum 2 is different.
FIGS. 18 and 19 are respectively the top view and the left elevation view of FIG. 17.
FIG. 20 is a front view of the blocking member 5.
FIGS. 21 through 23 are respectively the right elevation view, the bottom view and the top view of FIG. 20.
FIG. 24 is a front view of the cigarette holding member 52.
FIGS. 25 and 26 are respectively the right elevation view and the top view of FIG. 24.

As shown in FIG. 1, the cigarette case 1 is an elongated body having a cover 11 on one side (see FIGS. 6, 8 and 9 concurrently). The cover 11 is pivotally connected to the cigarette case 1 through an axle 12, which is used as a center of rotation for opening the cover 11. The cigarette case 1 comprises a push plate 13 having a curved surface (shown by dotted lines in FIGS. 1 and 5). The push plate 13 can be pushed to its right for pushing cigarettes. The two edges 131 of the push plate 13 are abutting the inner wall of the cigarette case 1 to prevent the push plate 13 from tilting when it is pushed. The left side of the push plate 13 is provided with a spring 132 for pushing the push plate 13 to the right side. The center on the left side of the push plate 13 is connected to a pull string 133, which is inserted through a hole 133A located at the center of the left wall of the push plate 13. The pull string 133 can be pulled from outside of the cigarette case 1 so that the push plate 13 inside the cigarette case 1 can be pulled to the left side. The end of the pull string 133 is connected to a ring 1331, which is used to attach onto a hook 1331A when the pull string 133 pulls the push plate 13 to the left side, so that the push plate 13 can be maintained on the left side for loading the cigarettes when the cover 11 is open.

Figure 2:
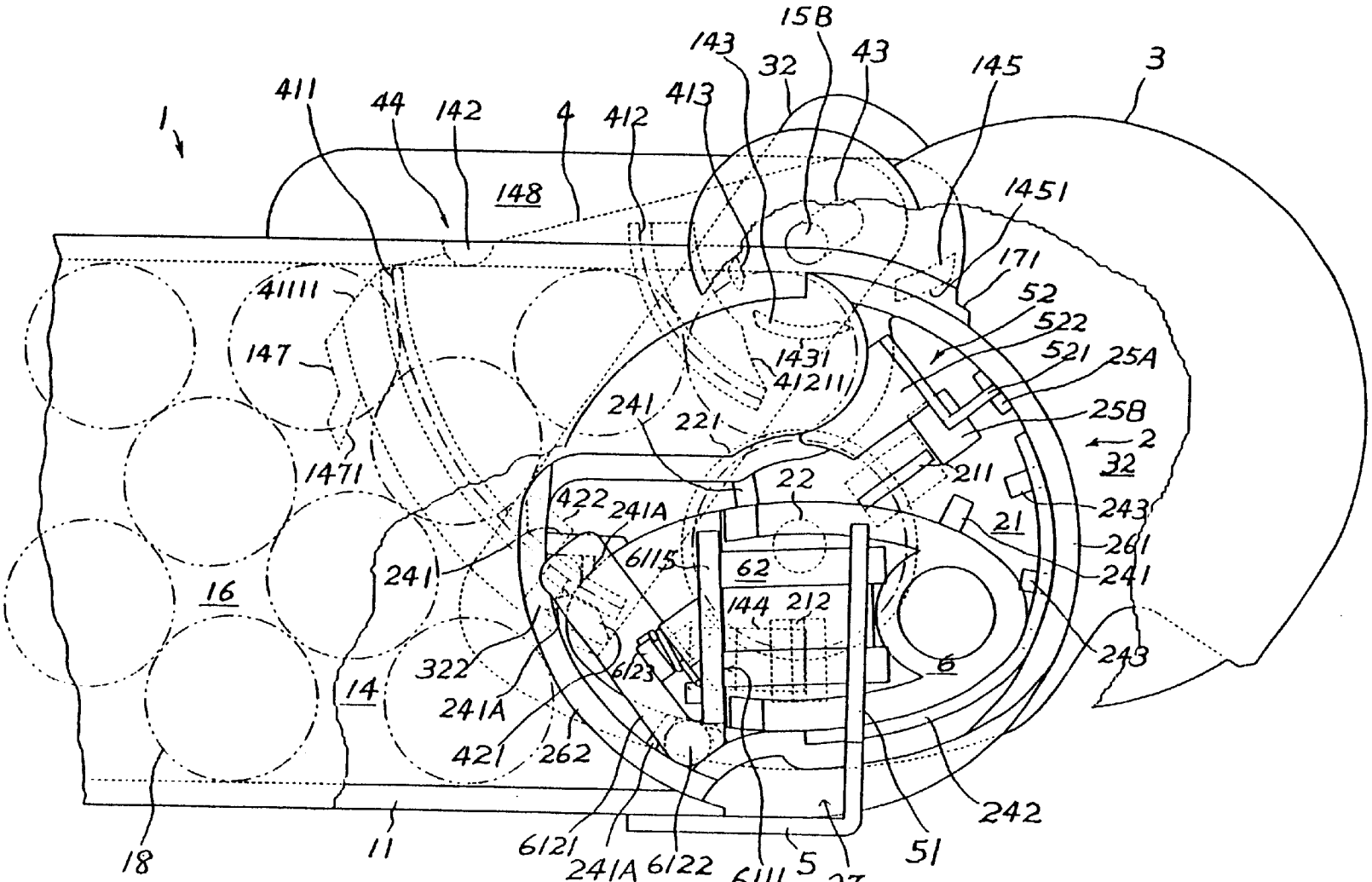
FIG. 2 is a front view of the sector gear used as a driving device for the turning drum according to the present invention.

Referring to FIG. 2, the turning drum 2 is rotatable about an axle. (shown by dotted lines in FIG. 2) The axle 22 can be seen in FIG. 4 as the bottom plate 21 of the drum 2 is removed. The axle 22 is fed through a hole 141 located on the lower side plate 14 of the cigarette case 1. The exterior of the turning drum 2 is provided with an elongated curved recess portion 23 (see FIGS. 10 and 11) for holding cigarettes 18 in the case. (The cigarettes 18 are shown by phantom lines in FIGS. 2 through 4. The turning drum 2 is provided with several assembling strips 241 surrounding the lighter 6 and extend from the axial direction of the bottom plate of the drum 2. The lighter 6 is tightly fitted into the assembling strips 241 and the inner wall of the drum 2. If the lighter 6 needs to be replaced, it can be pulled out in the axial direction for replacement. The inside wall of the turning drum 2 (close to the flame of the lighter 6) is provided with several layers of protective plates 242, which are made of a heat-insulated material such as mica or aluminum foil. Same protective plates 242 are provided between the lighter and the wall of the drum, while the other are placed in the protective assembling strips 243, which are extended from the bottom plate 21 of the drum 2 along the wall in the axial direction. When the lighter 6 is lighted for a longer time, the wall of the turning drum 2 is protected from burning and damaging.

Referring to FIGS. 24 through 26 and FIGS. 10 and 11, the inside of the turning drum 2 is provided with a cigarette holding member 52. The elongated strip 251 underneath the cigarette holding member 52 is inserted slots 25A1 and 25B1 of the holding member assembling strips 25A and 25B of the turning drum. The curved surface 522 provided in the upper part of the holding member is used for holding cigarettes.

In FIGS. 10 through 12, the upper edges 261, 262 on the same circumference can be touching the inside surface of the top side plate 16 of the cigarette case during the rotation, so that the turning drum 2 is not easy to be tilted. When the exterior corrugated portion of 27 the drum 2 is turned, cigarettes inside the case 1 are pushed and loosened. At the same time, any cigarette that is tilted can be straightened. The upper edge 271 of the corrugated portion 27 is lower than the upper edge 261 and 262, during the rotation the blocking member 5 will be prevented from touching. The bottom plate 21 of the turning drum 2 is provided with elongated standstill holes 211 and 212 (as shown in dotted lines in FIG. 2 and phantom lines in FIGS. 11 and 12). The bottom side plate 14 of the cigarette case 1 is provided with standstill resilient plate 144, the active end of which is provided with suitable circular arc 441 for latching into holes 211 and 212 for stopping. The exterior surface of bottom plate 21 is provided with suitable slanted surface 213 for guiding the circular arc 1441 into holes 211 and 212. When the circular arc 1441 of the resilient plate is latched into hole 211, the turning drum 2 is stopped and the revolving cigarette will be located in a position suitable for lighting. When the circular arc 1441 of the resilient plate is latched onto hole 212, the turning drum 2 is stopped in a suitable location of the cigarette case 1.

Figure 3:
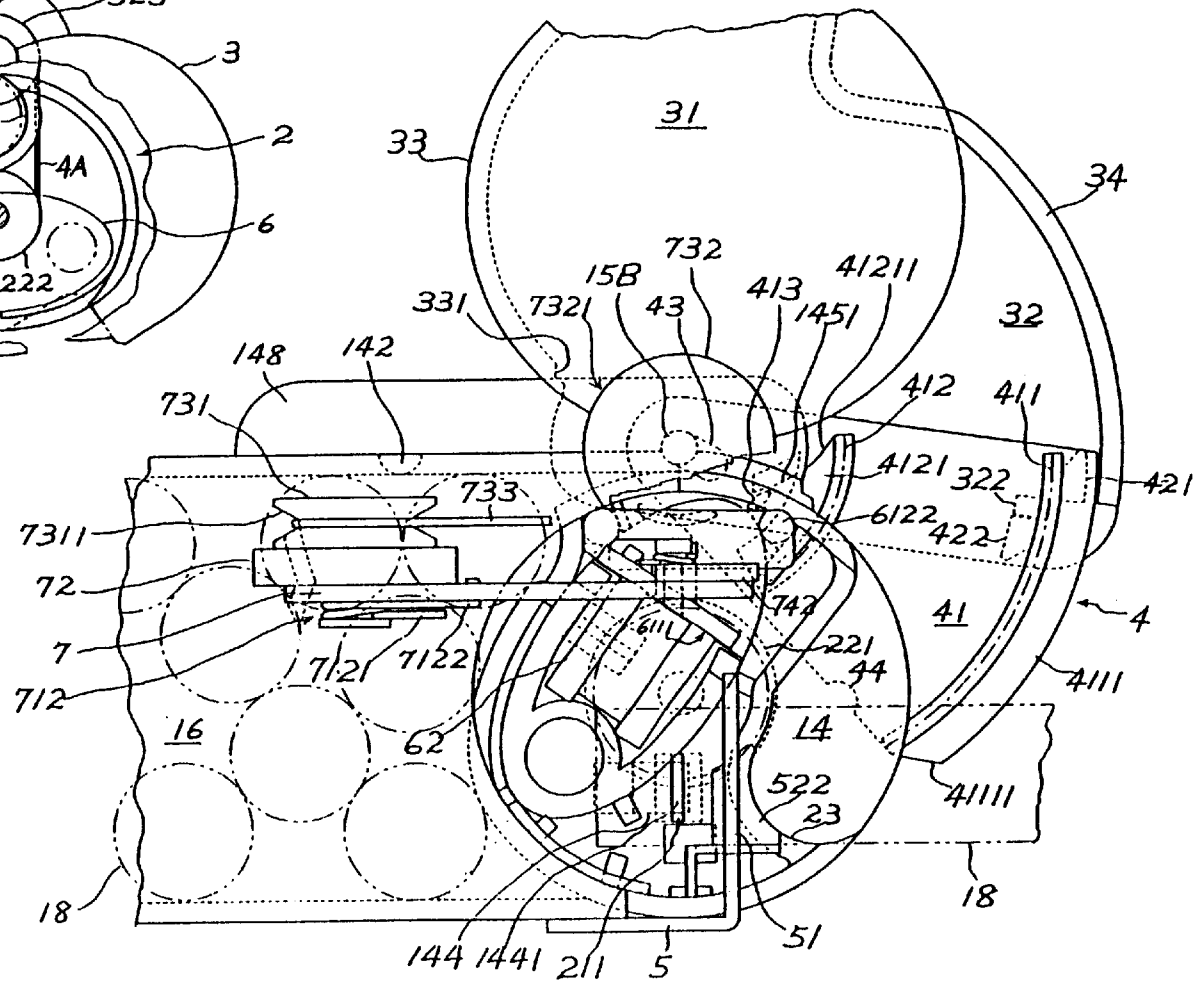
FIG. 3 is another view of the automatic cigarette case in FIG. 2, in which the lid of the turning drum is wide open.
Figure 37:
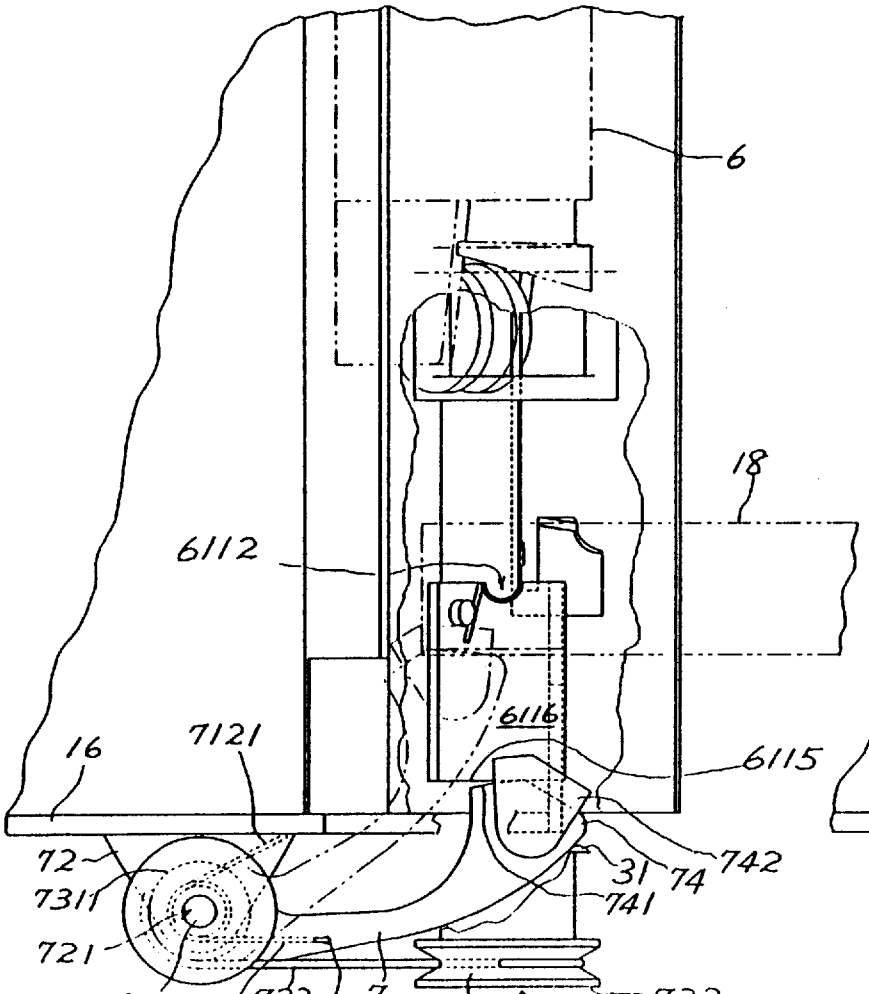
FIG. 37 shows a top view of FIG. 3, with the lid removed, leaving only the driving wheel 732 of the press arm driving device.
Figure 39:
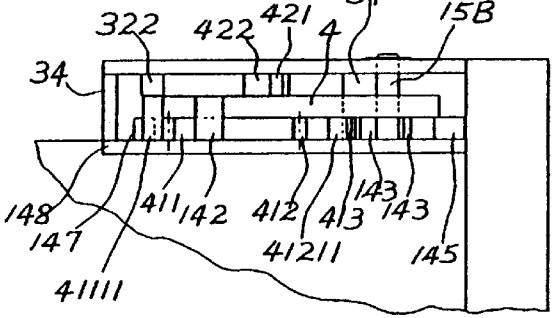
FIG. 39 is a top view of FIG. 1.

For the lighting device, please refer to FIGS. 28 through 31 for details of turning part 611 of the lighting member 61 and the striking wheel 62 of lighter 6. The turning surface 6111 is rough or is provided with an appropriate creased surface. The surface 6111 is in contact with the striking wheel 62 of the lighter 6. When the turning surface 6111 is pressed down, it contacts the striking wheel 62 of the lighter 6 so that the lighter 6 is turned to light the cigarette. The press member 612 of the lighting member 61 is shown in details in FIGS. 32 through 35, in which the press member plate 6121 is substantially elongated in shape. The bottom surface 61211 is used to press a key of the lighter 6 so that butane from gas well can be discharged for burning. On each side underneath the press member plate is provided with a guide post 6122, which is used to insert into a hollow tube in the axial direction surrounded by rib 241A for up and down movement in the axial direction. The rib 241A is extended from the bottom plate and along the inside wall of the turning drum 2. The rib 241A is also used to press against the lighter 6. Its function is similar to that of the assembling strips 241. For lighters without the striking wheels, the guide post and rib 241A are not needed, therefore, they are not shown in FIG. 11. Inside the hollow tube, underneath the guide post 6122 is provided with a spring 61221 (shown by phantom lines in FIG. 36), which is used to bounce up the guide post. The press member plate is extended and provided with a plate member 6123 in the vertical direction, and the plate member is provided with a shaft member 6124 in the lateral direction. The shaft member 6124 can be fed through a hole 6112 underneath the turning part 611, thereby allowing a small amplitude of movement for the turning part during the operation, and therefore, enabling the turning part to maintain a good contact with the striking wheel. The side of the plate member 6123 is connected in parallel to a post member 6125, the top of which is provided with a supporting plate 6126 from which the turning part is supported. The top surface 61261 of the supporting plate butts against the bottom edge 6113 of the turning part 611. (see FIGS. 36, 2 and 3). FIG. 36 is the top view of the turning drum, components in the lighting portion and the holding member of FIG. 3. The lighter and the blocking member are shown in phantom lines. The short post 6127 on the bottom of shaft member 6124 is wound by a spiral spring 6128. One of the arm member 61281 of the spring butts against the post 6114 of the turning part, while another arm member 61282 is curved and hooked onto the side edge 61231 of the plate member 6123. The resiliency of spring 6128 is to maintain the contact between the bottom edge 6113 of the turning part and the top surface 61261 of the supporting plate; thus the turning part will not swing at random when it is not operating. In the top side plate 16 of the cigarette case, the rotational shaft 71 of the press arm 7 is fed through a shaft hole 721 at the supporting base 72, which is connected to the top side plate. The end of the rotational shaft 71 is connected to the driven wheel 731 of the press arm driving device so that the press arm 7 and the driven wheel 731 can be rotated together. The upper side plate 31 of the lid holds the driving wheel 732 in place. An end of the pull string 733 is wound around an string groove 7321 so that it is secured with the driving wheel. The other end of the pull string 733 is wound around the string groove 7311 and secured with the driven wheel. (see FIGS. 37 and 39). When lid 3 is open, the press arm 7 will swing up from the position of the top side plate, then it is turned to the press arm border 74 located on top of the turning drum. By continuing to open lid 3, the pressing surface of the press arm border starts to touch the top edge 6115 of the turning part 611. The side of the press arm border 74 is attached with a press protective plate 742. As the pressing surface 741 touches the top edge 6115 of the turning part, this press protective plate butts against the back side 6116 of the turning part, so as to prevent the latter from rotating around its hole 6112 and departing from the striking wheel of the lighter 6. In addition, the turning surface 6111 can be pressing tightly against the striking wheel. The turning part 611 is made of a material with a suitable resiliency, so that during the pressing down, minor deformation is allowed to comply to the requirement. When the press arm continues to press down on the turning part, the striker wheel 62 can be turned and the lighter key can be pressed down to light. The position being pressed down to the bottom is shown by phantom lines in FIGS. 37 and 39. The press arm shown in FIG. 3 is a view in which the position of the pressing surface begins to press the turning part. When the press arm is withdrawn from the top edge of the turning part, since there is no restriction from the press protective plate 742, the turning part can be turned around its hole 6112 and disengaged from the striking wheel and so the spring provided below guide post 6122 can easily bounce up the press member and the turning part.

The other end of the rotational shaft 71 of the press arm is connected to a short post 711, which is wound with a torsional spiral spring 712. One arm 7121 of the spring 712 is pushing against the top side plate 16 of the cigarette case 1. The other arm 7122 is curved and fed through a hole 75 of the press arm. When the lid is open, the resiliency of the spring 712 causes the press arm to rotate back to its starting point, and the driven wheel 731, the pull string 733 and the driving wheel 732 also return to their own starting position.

When the press arm border 74 is lifted up to withdraw from the turning part, the guide post 6122 of the press member and the spring 61221 provided on the bottom plate 21 of the turning drum (as shown by phantom lines in FIG. 26) will bounce up the press member so that the lighting component returns to its starting position.

Figure 38:
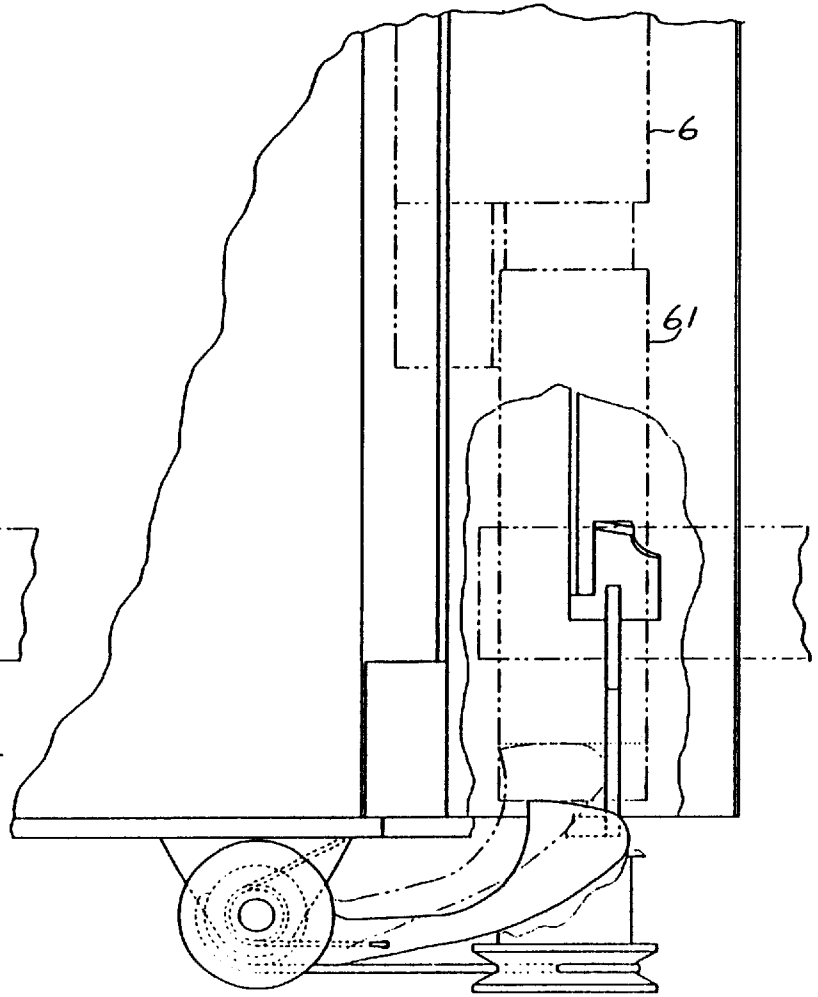
FIG. 38 is another top view of FIG. 3, but the embodiment shown is an electronic lighter with a lighting key 61, (shown in imaginary lines), lid 3 is also removed with only the driving wheel 732 remaining.

If the lighter used is the type with a keypad for lighting (such as the electronic lighter), then the starting of the lighter can be simplified into an extended keypad 61 (see FIG. 38). The press arm border 74 and the shape of the pressing surface 741 are modified as shown in FIG. 38, in which the press protective plate 742 is being eliminated to start the lighter.

Figure 27:
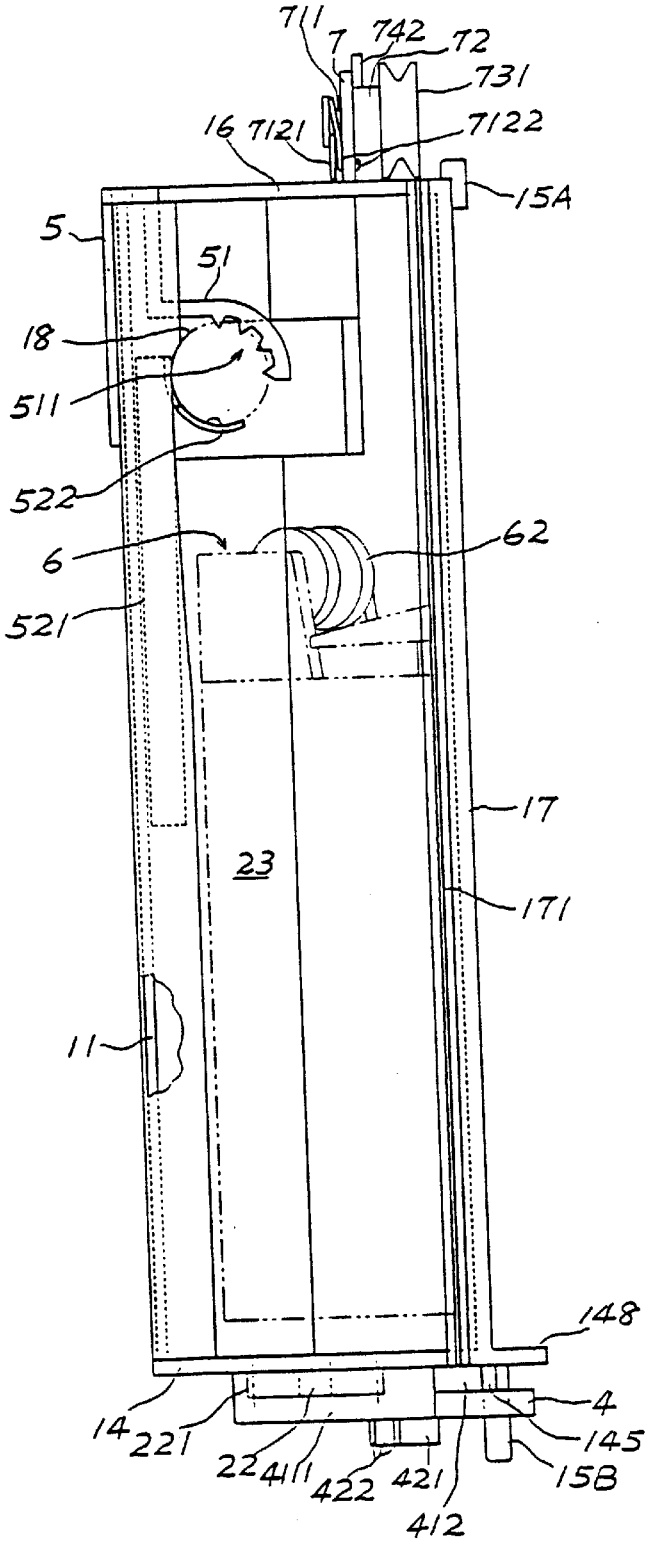
FIG. 27 is the right elevation view of FIG. 3 with the lid 3 removed.
Figures 28, 29, 30, 31, 32, 33, 34, 35, 36:
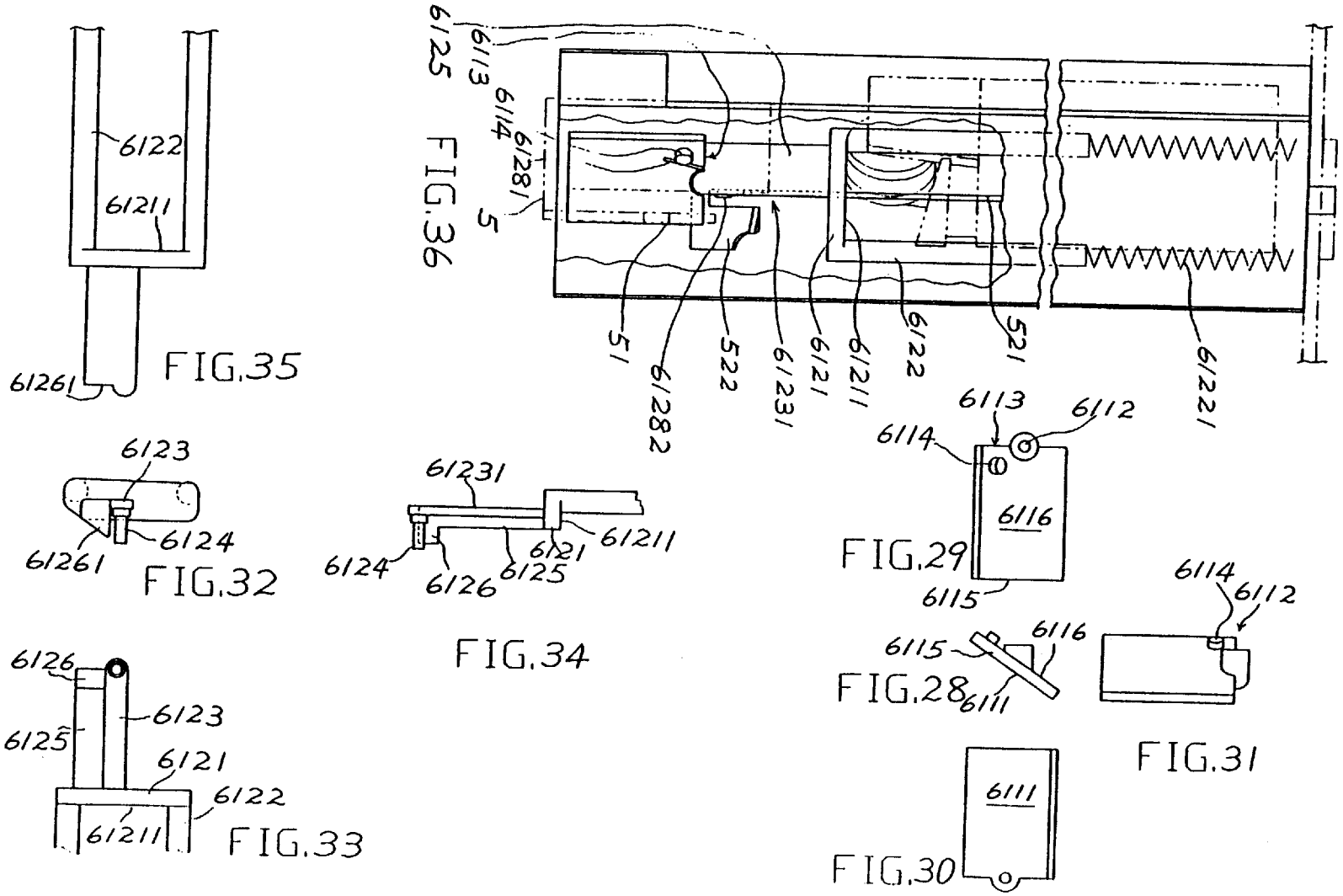
FIG. 28 is the front view of the turning part 611 for lighting the cigarette lighter.
FIGS. 29 through 31 are respectively the top view, the bottom view and the right elevation view of FIG. 28.
FIG. 32 shows the front view of the press member 612 for lighting the cigarette lighter.
FIGS. 33 through 35 are respectively the bottom view, the right elevation view and the top view of FIG. 32.
FIG. 36 shows a top view of the assembly in which the turning drum 2, lighting member 61 and holding member 52 are put together, the lighter and the blocking member 5 are shown in imaginary lines.

The driving device of the turning drum 2 may have a variety of configurations as long as its turning requirement is satisfied. Sector gear type, pulling member driving device type, feeding device and transmission wheel device are listed in this case. FIGS. 2 and 3 show a sector gear used as a major component of the driving device. The upper side plate 31 and the lower side plate 32 of the lid 3 of the turning drum are respectively provided with shaft holes 311 and 321, from which the shafts 15A and 15B outside of the cigarette case 1 are attached for rotation (see FIGS. 5 through 7 and FIGS. 17 through 19 simultaneously). The curved side plate 33 of the lid not only can accommodate the turning drum, but it also can cooperate with the circular portion on the right-hand side of the cigarette case, and the circular upper side plate 31 of the lid cooperates with the missing semi circle on the right-hand side of the top side plate 16. In addition, the staircase edging 331 of the curved side plate 33 cooperates with staircase edging 171 extended from the right side of the back side plate 17 of the cigarette case. By means of this configuration, the turning drum 2 can be completely sealed when lid 3 is closed. The front surface 41 of the sector gear plate 4 (see FIGS. 13 through 16) consists of protruded curved inner gear 411 and outer gear 412, these two sector gears having their teeth meshed with the teeth of the gear 221 on axis 22 of the turning drum 2. (Its addendum circle is shown by dotted lines and its pitch circle by center lines in FIGS. 2 and 3.) Since the distance between the inner and outer sector gears is larger than the outside diameter of gear 221, therefore, the two sectors gears will not come into contact with gear 221 at the same time. The inner and outer gears are respectively provided with bases 4111 and 4121, which are interconnected with the sector gear plate 4. The shaft 15B outside of the cigarette case is coupled to the elongated hole 43 of the sector gear plate 4 for free movement. The reverse side 42 of the sector gear plate 4 is provided with protruded turning block 421 and protruded recovery block 422, which come in contact with the driving block 322 (which is provided on the lower side plate of the lid) and be pushed. The semi-circular notch 44 of the gear plate cooperates with the semi-circular blocking post 142 (which extends downward from the bottom side plate) so that the gear plate 4 can be blocked. When operation begins, lid 3 is closed and the gear plate 4 is located at the left most position, (shown by dotted lines in FIG. 2). The shaft 15B is located below the elongated hole 43. When it is turned and the lid is open to a distance as shown in FIG. 2, the driving block 322 of the lid starts to touch the protruded turning block 421 of the gear plate. Then, the inner gear starts to touch the gear 221 of the turning drum, causing the turning drum to rotate in the counter clockwise direction. When the inner gear touches the gear 221, the arc-shaped block 143 protruded from the bottom surface 146 of the bottom side plate 14 also begins its position between the arc-shaped base 4121 and protruded block member 413 (the protruded block member is protruded from the front surface 41 of gear plate). Therefore, when the gear plate is rotated in a counter-clockwise direction, it will assure that the gears of inner gear and gear 221 are meshed together without falling apart. The exterior surface on the right side of cover 11 of the cigarette case is provided with a blocking member 5, (see FIGS. 20 through 23), the slim forward portion of the blocking member 5 is curved to reach the top portion of the turning drum, as the turning drum is rotated in a counter-clockwise direction, the cigarettes originally contained in the recess portion 23 will be rotated together with the recess portion. When the recess portion rotates to the outside of the cigarette case, the cigarette close to the lighting portion will come in contact with a portion 51 extended from the lateral direction of the blocking member. In the meantime, the other end of this cigarette will be stuck up, (refer to FIG. 27). When the recess portion is rotated to a position as shown in FIG. 3, this cigarette have revolved 90°. At this time the bottom of cigarette 18 is supported by the arc-shaped surface 522 of the cigarette holding member 52, and the top of cigarette 18 is griped tightly by the sharp teeth portion 511 of the blocking member. At the same time, the standstill hole 211 of the bottom plate 21 of the turning drum has just reached to the standstill resilient plate 144 provided on the inner surface of bottom side plate 144 of the cigarette case, allowing arc portion 1441 of the resilient plate 144 to hook onto standstill holes 211. Thus the position of the turning drum is fixed, the position of the cigarettes revolved is also fixed. Before the turning drum reaches this standstill position, the slant surface of the base 4121 of the outer gear starts touching slant surface 1451 of the protruded block 145, thus the sector gear plate 4 moves in a direction away from the center of the circle. When it reaches the position as shown in FIG. 3, shaft 15B is already at the top of the elongated hole 43, the protruded block 421 also displaced and disengaged from the driving block 322. By such configuration, when the lid continuous to be open, the sector gear plate will not follow the movement.

At this time, the pressing surface 741 of the press arm border 74 starts touching the top edge 6115 of the turning part 611. Continuing to open the lid 3, the press arm will initiate the lighting member to press down to light the cigarette.

When lid 3 is closed, spring 712 pulls the pull string 733 backward. When it reaches the position as shown in FIG. 3, the driving block starts touching the protruded recovery block 422, pushing the sector gear plate 4 to rotate in a clockwise direction. Then the outer gear 412 starts touching gear 211 of the turning drum, allowing the turning drum 2 to rotate in a clockwise direction. When the outer gear and gear 2221 start touching, the protruded block member 413 also starts touching the exterior arc surface 1431 of the arc-shaped block 143 of the bottom surface 146 of the bottom side plate. Therefore, when the gear plate is rotating in a clockwise direction, it will assure that the gears of the outer gear and gear 211 will be meshed together without falling apart. When the outer gear finishes the rotation with the gear 211 and begins to disengage, the slant surface 41111 of the base of the inner gear gets into contact with the slant surface 1471 of the starting-point protruded block 147 of the bottom surface 146 of the bottom side plate 14 of the cigarette case, allowing the sector gear plate to move toward the center of the circle. Further, the protruded recovery block 422 also moves toward the center and disengage from the driving block 322 of the lid. (As shown in FIG. 2, the turning drum also rotates to the position as shown in this Figure.) The next time the lid is open, the driving block 322 will push the protruded turning block 421.

At the edge of the lower side plate 32 of the lid is provided with a cover plate 34, which is perpendicular to the edge and is curved into an arc shape, the cover plate is used to cover part of the driving device of the turning drum. In addition, another cover plate 148 extended from the edge of the bottom side plate 14 may also be used to cover part of the driving device of the turning drum.

Figure 4:
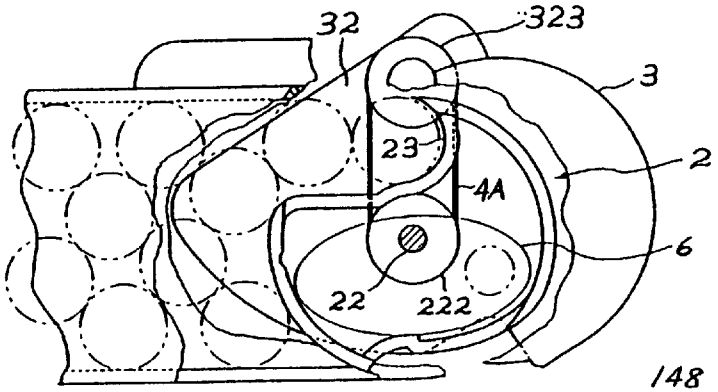
FIG. 4 is a front view of the automatic cigarette case in which a belt wheel or a rope wheel is used as the driving device of the turning drum, all the components in the turning drum being not shown in this drawing.
Figure 7:
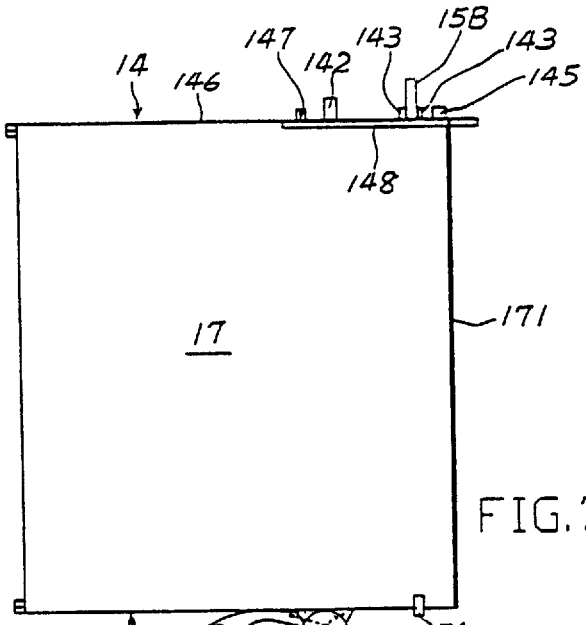
FIGS. 6 through 8 are respectively the bottom view, the top view and the right elevation view of FIG. 5.

The transmission device for lid 3 and the turning drum by using some simple pulling member driving device are shown in FIG. 4. In order to clearly indicate the structure of the transmission, all of the components and the bottom plate of the turning drum 2 are removed. The right portion of the cigarette case 1 is also removed. The axle 22 underneath the bottom plate is shown in its sectional view. As a set of rotating wheels for transmission, the driving wheel 323 is secured onto the lower side plate 32 of the lid, the driven wheel 222 is secured with the axle 22 of the turning drum, and the pulling member 4A is wound around the driving wheel 323 and the driven wheel 222. Thus the turning drum 2 turns counter clockwise when the lid 3 is open, cigarettes in the recess portion 23 is being revolved and the press arm 7 starts to light the lighter 6. As soon as the cigarette completes the revolving, it will be lit. When the lid is closed, the turning drum reverses its rotation and returns to the position as shown in FIG. 4.

Figure 42:
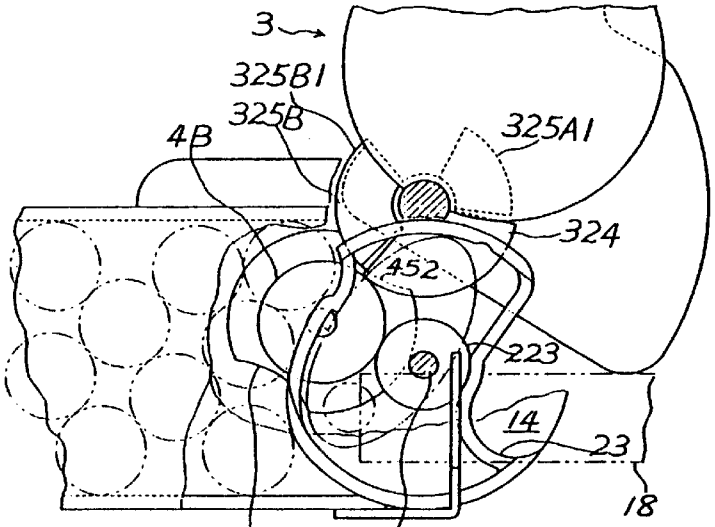
FIGS. 40 through 42 are the front views showing the transmission wheel being used as the driving device for the turning drum.
Figure 41:
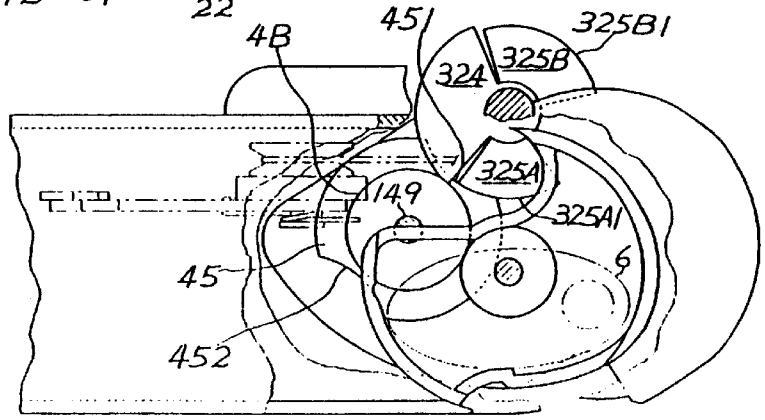
Figure 40:
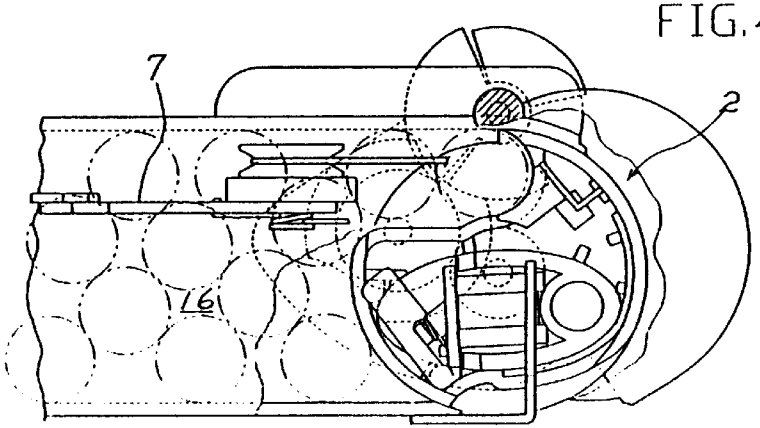

The method using the transmission wheel device to drive the turning drum is shown in FIGS. 40 through 42. FIG. 41 is a view of FIG. 40 in which the internal structure of the turning drum 2, components and the bottom plate 21, the right portion of the cigarette case, and the press arm 7 provided on the top side plate 16 of the cigarette case as well as their components are removed. The shape and position of these components are shown in phantom lines. The shape of lighter 6 is also shown in phantom lines. The driving wheel 324, the driven wheel 223, elliptic wheel 4B can either be a frictional wheel or a gear. The driving wheel 324 has a sector shape, another surface parallel to the driving wheel (but maintain a distance in between) is provided with arc-shaped plates 325A and 325B, the driving wheel 324, the arc-shaped plates 325A and 325B are secured with lid 3. The driven wheel 223 is secured to the axle 22 of the turning drum 2. The bottom side plate 14 of the cigarette case is provided with an axle 149. The elliptic wheel 4B pivotally connected to this axis can touch the driving wheel and the driven wheel for transmission. A blocking plate 45 which is in the same plane as the arc-shaped plates 325A and 325B is secured to the elliptic wheel. The arc-shaped portion 452 on the blocking plate cooperates with the arc-shaped edging 325B1 of the arc-shaped plate 325B. When the lid 3 is completely closed, the arc-shaped edging 325A1 of the arc-shaped plate 325A totally fits with arc-shaped portion 451 of the blocking plate 45; thus, the elliptic wheel and the driven wheel are stopped, and the turning drum also stops in the position as shown in FIG. 41. When the lid is open to a position as shown in FIG. 41, the arc-shaped edging 325A1 withdraws from the arc-shaped portion 451 slowly, the elliptic wheel starts to rotate, and the driving wheel also starts to touch the elliptic wheel, allowing the elliptic wheel to rotate in a clockwise direction. This type of transmission allows the driven wheel 223 and the turning drum to rotate in a counter clockwise direction. When the lid is open to the position as shown in FIG. 42, the cigarette has been stuck up and revolved, the driving wheel is separated from the elliptic wheel, the arc-shaped edging 325B1 of the arc-shaped plate 325B is slowly attached to the arc-shaped portion 452 of the blocking plate 45, causing the turning drum to be stopped. When the lid is closed, all of the wheels rotate in a reverse direction, and the recess portion 23 of the turning drum also returns to the inside of the cigarette case.

Figure 45:
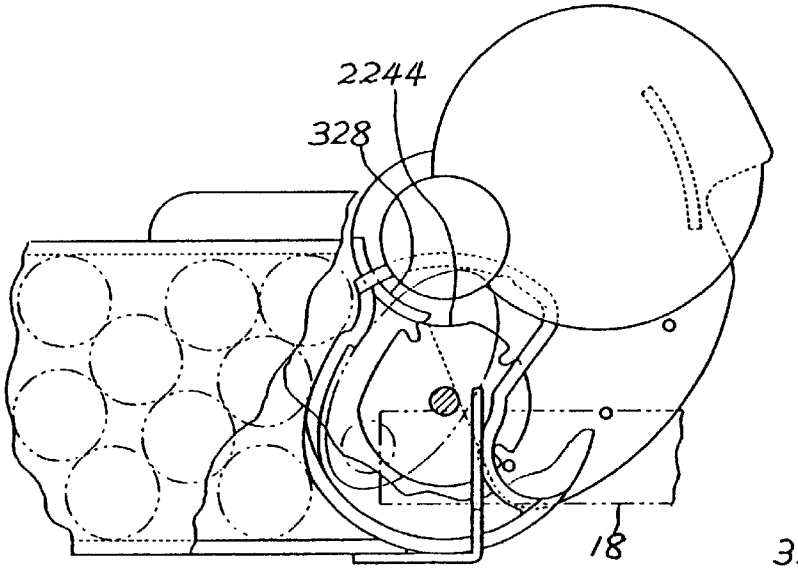
FIGS. 43 through 45 are the front views showing the pin wheel 326 is used to drive the turning drum.
Figure 44:
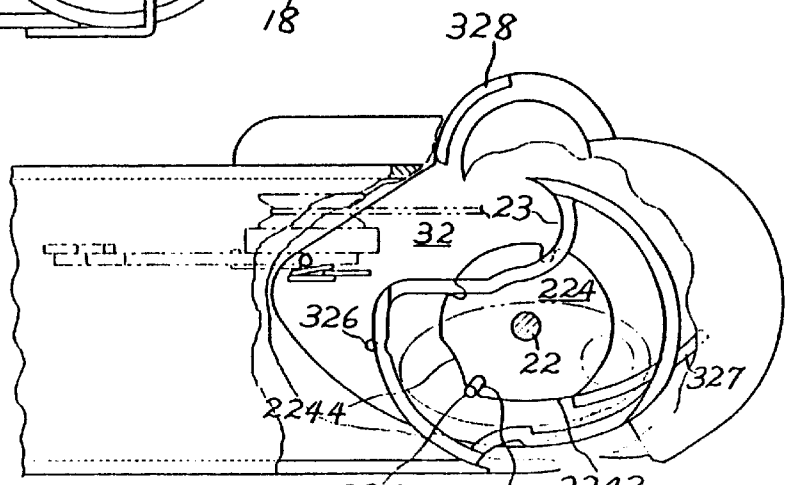
Figure 43:
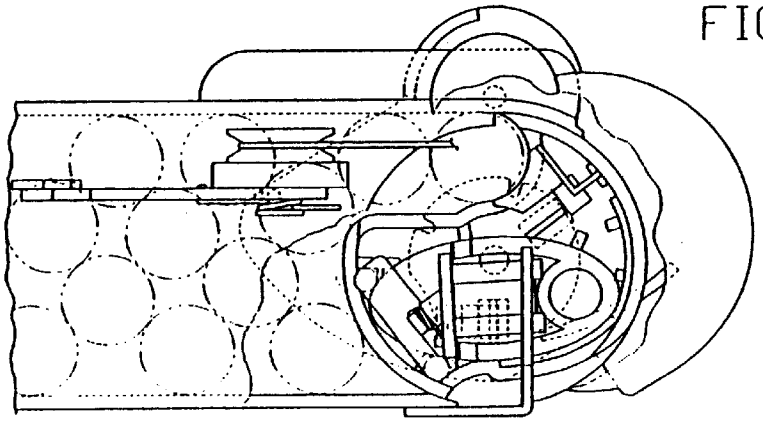

FIGS. 43 through 45 illustrate the turning drum being driven by the feeding device. FIG. 44 shows a view of FIG. 43 from which the internal structure, components and the bottom plate of the turning drum are being removed. The lower side plate 32 acts like a pin wheel, the internal surface of which has 3 pin-wheel teeth 326. Each of the teeth 326 shapes like a column with suitable height. A circular shaped guide member 224 is secured onto the axle 22 of the turning drum. The pin-wheel teeth is provided to cooperate with a slot 2241 of the guide member to push and rotate the guide member. The lower side plate 32 is provided with two stopping blocks 327 and 328 extended in arc shape and having the same height as the pin-wheel teeth. These two stopping blocks respectively cooperate with the arc-shaped portions 2243 and 2244 of the guide member. When they are attached together, they can stop the guide member from rotating. When the lid is closed completely, the stopping block 327 and the arc-shaped portion 2243 are attached together, the guide member 224 and the turning drum 2 are stopped in the position as shown in FIG. 44. As the lid is open to the position as shown in FIG. 44, the stopping block 327 departs from the arc-shaped portion 2243, and the pin-wheel teeth 326 begins entering the slot 2241 of the guide member 224, it pushes and rotate the guide member and the turning drum to rotate in a counter clockwise direction. When the lid is open to the position as shown in FIG. 45, the turning drum has already been turned to the position where the cigarette has been stuck up and revolved. At this time, the last pin-wheel teeth leaves the slot of the guide member, and the stopping block 328 is slowly attached to the arc-shaped portion 2244 of the guide member, causing the guide member and the turning drum to stop. When the lid is closed, the pin wheel (i.e., the lower side plate 32 of the lid), the guide member and the turning drum rotate in the reverse direction, the recess portion 23 is retract to the inside of the cigarette case.

Figures 46, 47, 48, 49, 50, 51, 52:
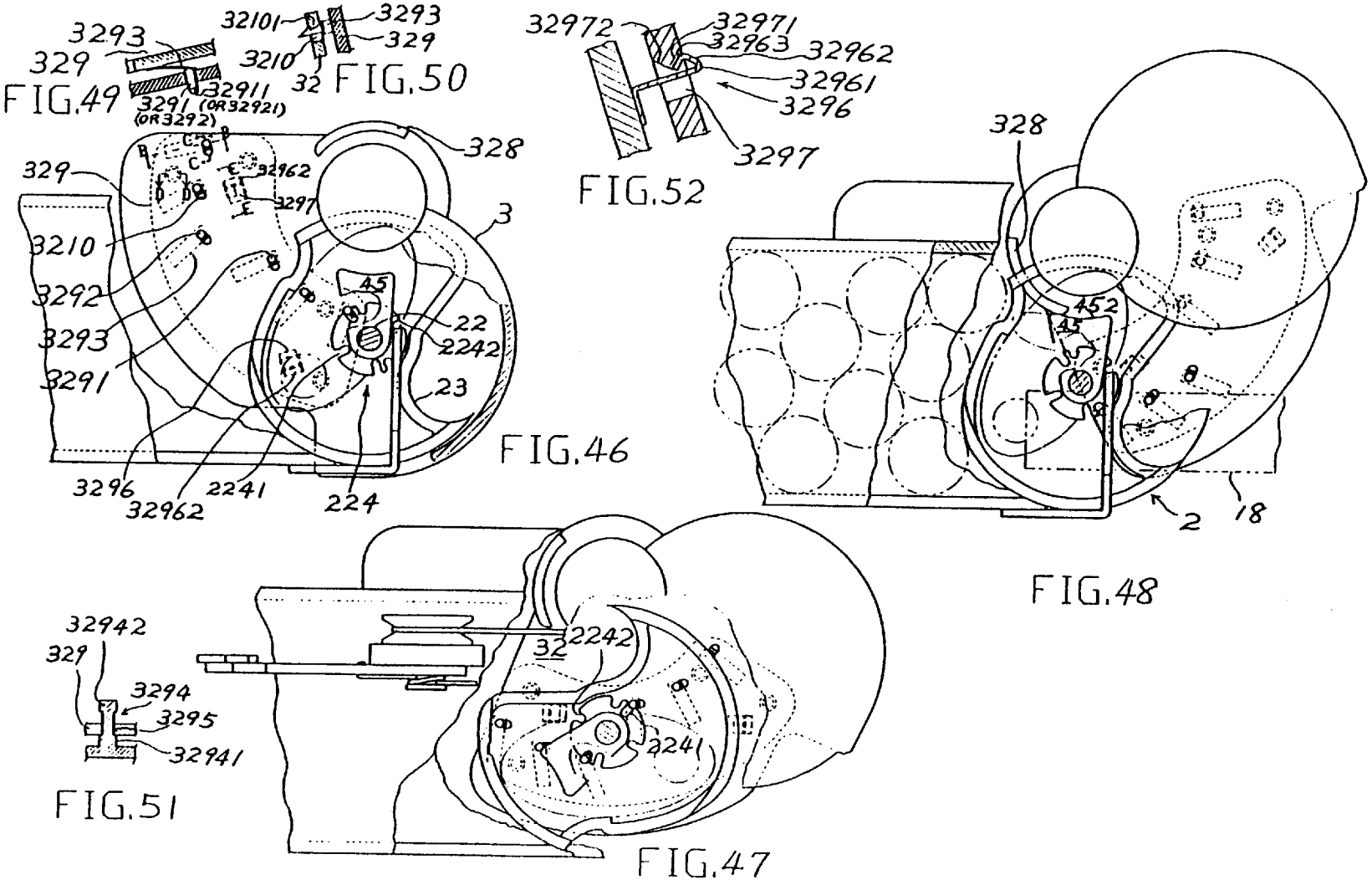
FIGS. 46 through 48 shows the front views in which another type of pin wheels 3291 and 3292 are used to drive the turning drum; in these views all of the components of the turning drum, together with bottom plate 21 and the right side portion of the cigarette case are removed for viewing the driving structure.
FIGS. 49 through 52 shows B—B section, C—C section, D—D section and E—E section of FIG. 46.
Figure 53:
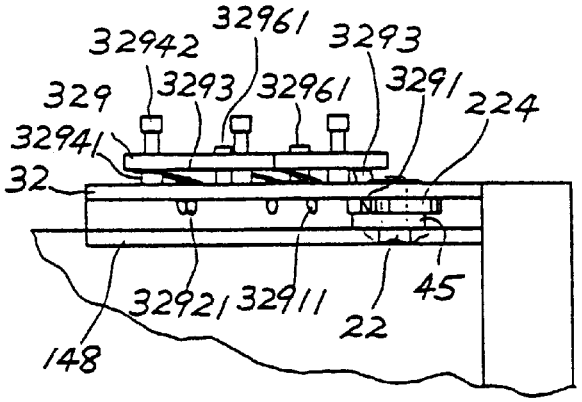
FIG. 53 shows a top view of the exterior of FIG. 46.
Figure 62:
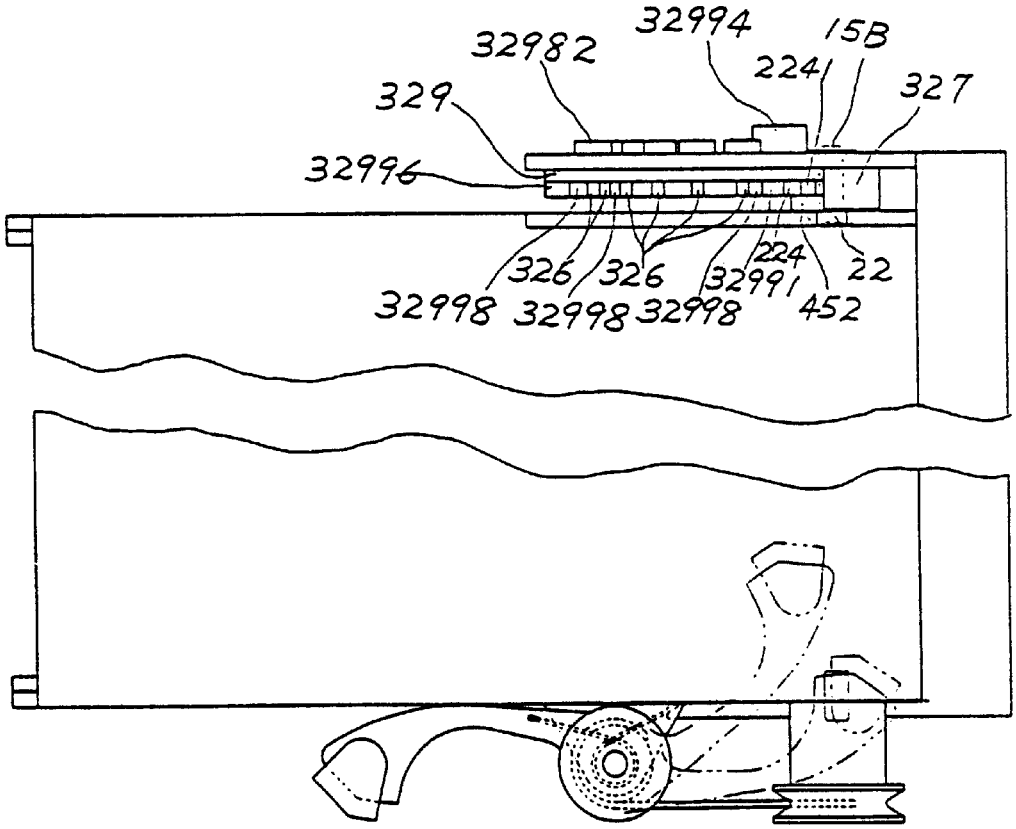
FIG. 62 is a top view of the exterior of FIG. 54.

FIG. 46 through 52 is a preferred embodiment using the feeding device to drive the turning drum. In FIGS. 46 through 48, the structure of the turning drum 2, components, the bottom plate 21 and the right portion of the cigarette case are removed. The bottom surface of the lower side plate 32 of the lid is provided with a pin-wheel plate 329, (see FIG. 53 concurrently). This pin-wheel plate is to equivalent a large and a small pin wheels that are coincide together. The teeth 3291 of the small pin wheel and the teeth 3292 of the large pin wheel are respectively secured to one end of the resilient plates 3293 (the resilient plates have the same size and shape), [see FIG. 49 (B—B section in FIG. 46)]. The other ends of the resilient plates are secured to the pin-wheel plate. The lower side plate of the lid is provided with elongated holes 3210 corresponding to the positions of the pin-wheel teeth. The holes are provided for the pin-wheel teeth to feed through so that the latter can come out from the lower side plate of the lid. The top of both of the column-shaped pin-wheel teeth 3291 and 3292 are provided with identical slant surface 32911 and 32921, [please refer to FIG. 50 (C—C section of FIG. 46)]. The lower part of the slant surfaces are provided with notches 32912 and 32922, which match with the protect portion 32101 at the edge of the elongated hole 3210, thus touching the slant surfaces 32911 and 32921 in the lateral direction (in a direction parallel to the surface of the lower side plate). The pin-wheel teeth 32912 or 32922 retract into the elongated hole 3210, touching the pin-wheel teeth in a reverse direction. The notches 32912 or 32922 and the project portion 32101 match together, and the pin-wheel teeth will not retract into the elongated holes. The axle 22 of the turning drum is secured to a blocking plate 45, below which is a guide member 224 that forms into a circular shape. The circumference of the guide member is provided with a long slot 2241 and a short slot 2242. The teeth 3291 of the small pin wheel can cooperate with the long slot 2241 to push and rotate the guide member. The pin-wheel teeth 3292 of the large pin wheel can cooperate with the short slot 2242 to push and rotate the guide member. When lid 3 is completely closed, the right most pin-wheel teeth 3201 stays in the long slot 2241 to prevent the guide member and the turning drum to rotate. The recess portion 23 stays outside of the cigarette case (as shown in FIG. 46). When the lid starts to open, the pin-wheel teeth 3291 of the small pin wheel pushes the guide member 224 so that the turning drum 2 rotates in the clockwise direction, allowing the recess portion 23 to turn into the cigarette case and allowing the cigarette to enter the recess portion. When it is rotated to the position as shown in FIG. 47, the pin-wheel teeth of the last small pin wheel depart from the long slot 2241 of the guide member. Meanwhile the pin-wheel teeth of the large pin wheel pushes and rotates the guide member, enabling the turning drum to rotate in the counter clockwise direction. When it reaches the position as shown in FIG. 48, the cigarette 8 in the recess portion has just revolved to the lighting position, at this time, the pin-wheel teeth of the large pin wheel leaves the short slot, the stopping block 328 slowly touches the arc-shaped portion 452 on the edge of the blocking plate45 and stops the blocking plate, guide member and the turning drum. When the lid is closed, all of the pin-wheel teeth use their slant surfaces 32911 or 32921 to touch the guide member 224. Therefore, as soon as the pin-wheel teeth touches the guide member, it will retract into the elongated hole 3210 and will not push the guide member. Hence, the recess portion 23 stays in the original position until the lid is completely closed.

If the lighter of the automatic cigarette case is to be used as lighting a fire or illumination, instead of lighting a cigarette, then the pin wheel plate can be pulled out so that all of the pin-wheel teeth retract into the elongated hole. The detail description is given as follows: The bottom surface of the lower side plate is provided with 4 guide post 3294, [see FIGS. 53 and 51, and the D—D section of FIG. 46.] The corresponding position in the pin-wheel plate 329 is provided with a hole 3295, which may slide on the guide post. In this way the pin-wheel plate can be moved in parallel to allow the pin-wheel teeth to expand and retract. The diameter of the root 32941 of the guide post is larger than the hole 3295, and the diameter of the top 32942 is also larger than the hole 3295. Hence, the pin-wheel plate is restricted in the central portion of the guide post for parallel movement. When the pin-wheel plate is pulled out and touches the top portion 32942, the pin-wheel teeth 3291 and 3292 retract into the elongated hole 3210 and will not touch the guide member 224. By this configuration, the turning drum maintains its position as shown in FIG. 48 when the lid is open or closed, the cigarette will not be shifted out from the case, and the lighter can be lighted after the lid is open. When the pin-wheel plate is pushed to touch the root portion 32942, the pin-wheel teeth stretches out from the elongated hole 3210 to rotate guide member. Then, the distance between the pin-wheel teeth and the external surface of the lower side plate 32 allows the retraction of the pin-wheel teeth, (when the slant surface 32911 or 32921 of the pin-wheel teeth touches the guide member, the pin-wheel teeth will retract into the elongated hole). In order to restrict the pin-wheel plate to remain in the position which touches the root portion when it is pushed or touches the top portion when it is pulled (and will not stay in between), the exterior surface of the lower side plate 32 is secured with resilient plate 3296 which is bent and is shown in FIG. 52, (E—E section of FIG. 46). The pin-wheel plate is provided with a hole 3297 in a position corresponding to the resilient plate. The hole is provided for the top portion 32961 of the resilient plate to feed through. One side of hole is provided with an upper slant surface 32971 and a lower slant surface 32972. The location where the resilient plate is bent is also provided with corresponding upper slant surface 32962 and lower slant surface 32963. When the pin-wheel plate is pushed to its limit (i.e., the pin-wheel plate touches the root position of the guide post), the slant surface 32963 of the resilient plate presses the upper slant surface 32971 of the hole. As the pin-wheel plate is pulled to its limit, (i.e., the pin-wheel plate touches the top portion of the guide post), the upper slant surface of the resilient plate 32962 presses the lower slant surface 32972 of the hole to latch the pin-wheel plate.

Figures 54, 55, 56, 57, 58, 59, 60, 61:
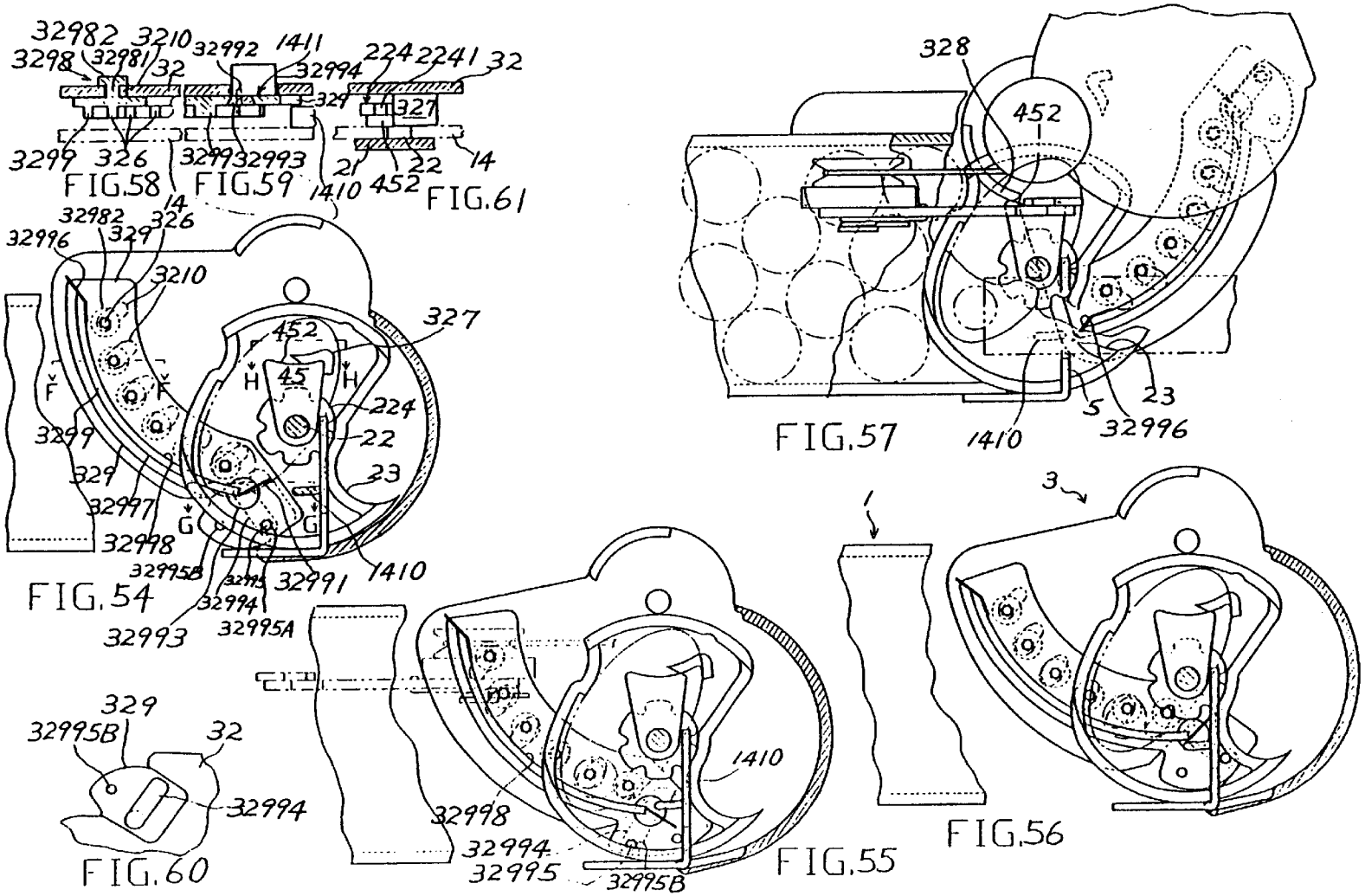
FIGS. 54 through 57 shows the front views in which another type of pin wheel 326 is used to drive the turning drum; in these views all the components of the turning drum, together with bottom plate 21, upper side plate 31 and the right side portion of the cigarette case are removed for viewing the driving structure.
FIGS. 58, 59 and 61 are respectively the F—F section, G—G section and the partial back view H—H section in the neighborhood of the directional rod 32994 of FIG. 54.
FIG. 60 is a back view of a section of the directional rod shown in FIG. 54.

FIGS. 54 through 62 show another embodiment of the driving device in which the turning drum is driven by the feeding device. The inner surface of the lower side plate 32 is provided with a pin-wheel plate 329, which has 6 pin-wheel teeth 326 protruded outward, (see FIG. 58 F—F section of FIG. 54). On the back of each of the pin-wheel teeth is provided with a latch 3298 for latching the pin-wheel plate onto the lower side plate. The root portion 32981 of each latch is free to move within a hole 3210 on the lower side plate. The diameter of the circular portion 32982 of the latch is larger than the size of the hole 3210 to prevent the pin-wheel plate to fall off. The pin-wheel plate is also provided with a long, protruded guide track 3299, which is bent to an arc shape having the same height as the pin-wheel teeth. The outer surface on the bottom side plate 14 o the cigarette case is provided with a protruded guide block 1410. [since the bottom side plate where the guide block is located has been removed, only sectional views of the guide block are shown in FIGS. 54 through 56. (see FIG. 59 G—G section of FIG. 54). The protruded guide block 1410 can touch the guide track. On the right side of the guide track is provided with a guide plate 32991 which is made of resilient material. The end 32992 of the resilient plate is curved and is inserted into a swivel latch 32993. The end of the resilient plate inserted into the swivel latch is shown by phantom lines in FIG. 59. A conical surface of the swivel latch is attached to a hole 1411 (with similar conical surface) on the bottom side plate 32, therefore, they can be turned without falling off. A directional rod 32994 is provided below the swivel latch, thus a finger can push the directional rod to change the direction of the guide plate. The directional rod is provided with a ball-shaped protruded block 32995, and the pin-wheel plate is provided with two holes 32995A and 32995B which can cap the ball-shaped protruded block, (FIG. 60 is a back view of a section of the directional rod in FIG. 54), thus the directional rod and the guide plate can be positioned. On the left side of the guide track is also provided with a guide plate 32996 which is made of resilient material and may come in contact with the guide block 1410. The axle 22 below the bottom plate of the turning drum is provided with a blocking plate 45, below which is secured with a circular guide member 224. The circumference of the guide member is provided with 6 slots 2241 which cooperate with the pin-wheel teeth 326. In addition, the inside surface of the lower side plate 32 of the lid is provided with a curved and protruded stopping block 327 which is used for stopping the blocking plate and preventing it from rotation. FIG. 61 is the H—H section of FIG. 54. The other similar stopping block 328 can come into contact with the arc-shaped portion 452 on the edging of the blocking plate to stop the blocking plate. In use, if a user wants to turn the turning drum to get to a cigarette, then he needs to push the directional rod to a position as shown in FIG. 54, allowing the ball-shaped protruded block to latch into hole 32995A. When lid 3 is open, the external arc surface 32997 of the guide track 3299 is guided by the guide plate 32991 to come into contact with the guide block 1410 so that they can slide, allowing the pin-wheel plate 329 to move in an upward direction as shown in FIG. 56. (Since the root portion 32981 can move freely inside the hole 3210, as described earlier). Each of the pin-wheel teeth can, therefore, be inserted into the slot 2241 of the guide member, allowing the guide member and the turning drum to rotate in a counter clockwise direction. When the lid is open to the position as shown in FIG. 57, the turning drum has rotated 360° in a counter clockwise direction, the recess portion 23 has entered the cigarette case and a cigarette is shifted out. In addition, by use of the blocking member 5, the cigarette is revolved and stuck up to the lighting position. By opening the lid and use the lighter the cigarette can be lighted. In addition, when the lid is open to the position as shown in FIG. 57, the stopping block 328 slowly touches the arc-shaped portion 452 so as to stop the blocking plate, the guide plate and the turning drum. When the lid is closed, the guide plate 32996 on the left side of the guide track comes in contact with guide block 1410 and slides. Thus all the pin-wheel teeth will not be able to touch the guide member, therefore, the guide member and the turning drum remain in their original positions.

If a cigarette does not need to be lighted, instead, the lighter needs to be ignited for other purpose, then the turning drum does not need to be turned when the lid is being opened. At this time, the directional rod 32994 needs to be pushed to the position as shown in FIG. 55, allowing the ball-shaped protruded block to be inserted into hole 32995B. When the lid is open, the guide plate 32991 guides the guide track so that its inside arc surface 32998 comes in contact with the guide block 1410, thus the position of the pin-wheel plate shifts down from its position in FIG. 55, and each of the pin-wheel teeth will not touch the guide member, therefore, the turning drum will not rotate. By opening the lid the lighter can be ignited.

Figure 63:
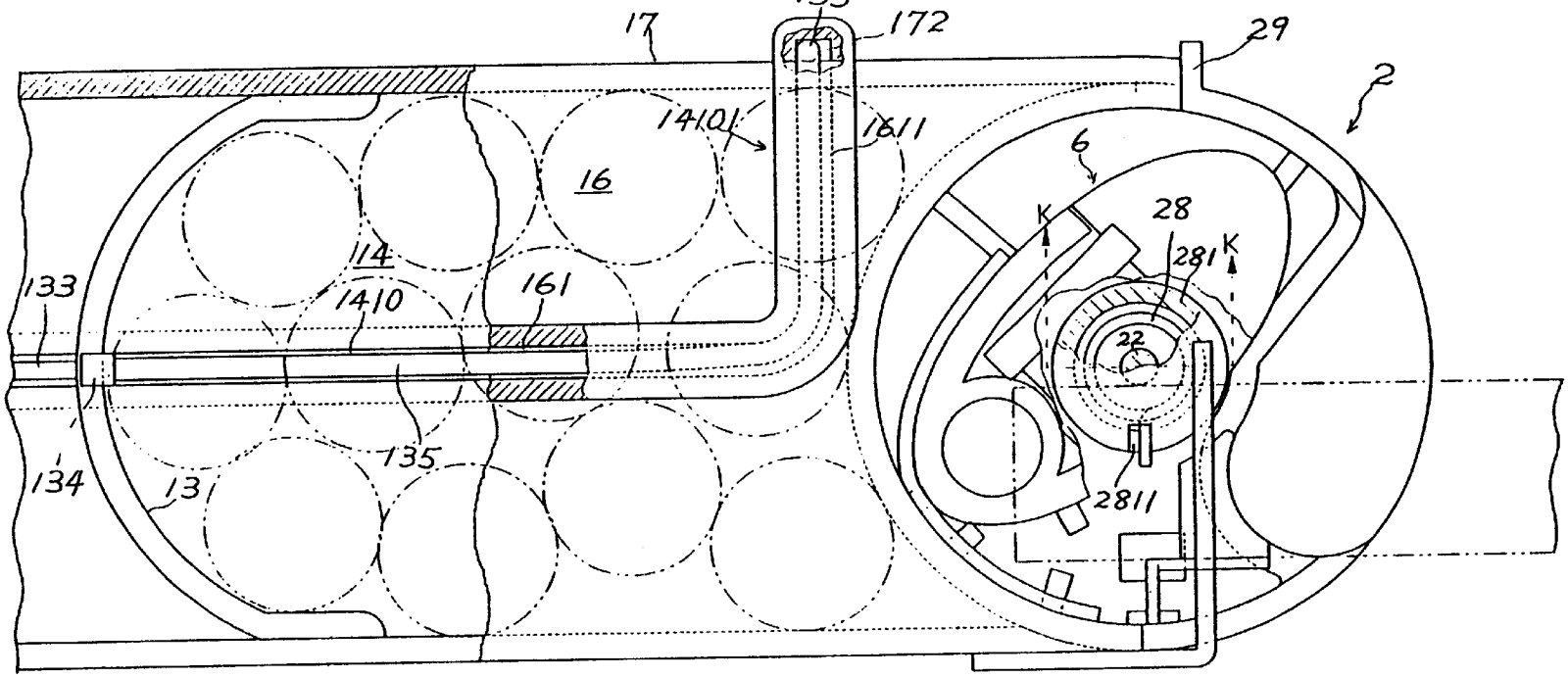
FIG. 63 is a front view of the most simplified embodiment of the automatic cigarette case.

FIG. 63 shows the most simplified embodiment of the automatic cigarette case according to the present invention. The turning device in this Figure consists of the turning drum 2, and the recovery spring 28; the lighting device is made up of lighter 6; the pushing plate inside the cigarette case is curved into a "C" shape, the central portion of the upper and the lower parts are provided with protruded sliding blocks 134, (only the upper sliding block can be seen in FIG. 63). The sliding blocks 134 respectively slide inside slot 161 provided on the upper side plate 16 of the cigarette case, and inside the slot 1410 provided on the inner part of the lower side plate. The front of the sliding block on top of the push plate is connected to a resilient retractable cable (or rubber band) 135. This resilient retractable cable passes through slot 161 and around the vertical branch 1611, passing though the square tube 172 of the rear plate 17 of the cigarette case to reach the vertical branch 14101 of the slot of the lower side plate 14 of the cigarette case, (in the Figure, slot 161 and the vertical branch coincides with each other, therefore, they cannot be seen), and then it is routed through the slot 1410 to connect to the sliding block below the push plate. Thus the resilient retractable cable can pull the top and bottom of the push plate towards the right side. The pull string 133 is used to pull the push plate towards the left side for adding new cigarettes to the case.

Figure 64:
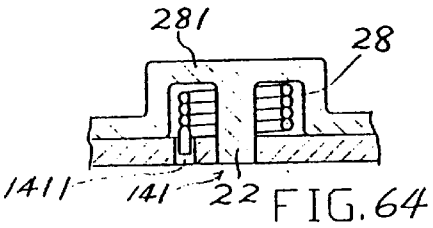
FIG. 64 is the K—K section of FIG. 63.

The turning drum is substantially cylindrical in shape, the corrugated portion 27 as described earlier is not provided. Axis 22 is fed through the hole 141 provided on the lower side plate of the cigarette case so that it can rotate. Part of the top of the turning drum is still supporting the inner surface of the upper side plate 16. The top of the recovery spring 28 is hooked onto the hole 2811 of the spring box 281, the lower part is hooked onto the hole 1411 of the lower side plate. FIG. 64 is the K—K section of FIG. 63. The resiliency can cause the turning drum to turn in a counter clockwise direction. In use, a finger can push the turning drum in a clockwise direction, so that the recess portion 23 is rotated inside the cigarette case to withdraw the cigarette. The finger can then be released and the recovery spring causes the turning drum to rotate in a counter clockwise direction, the cigarette is shifted outside of the case and revolved to a lighting position. At this time, the stopping block 29 provided on the turning drum touches the edging of the rear side plate 17 of the cigarette case, causing the turning drum to stop. The cigarette being revolved is secured in the position ready to be lighted, and finger can then be used to light the cigarette.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatic cigarette case comprising a cigarette case, a turning device, a revolving device and a lighting device;

whereby said cigarette case can be used to hold cigarettes;

said turning device comprises a turning drum, exterior of said rum is provided with a recess portion for holding cigarettes, the turning drum has an axle connected to said cigarette case for rotation, the turning drum is located on a side of said cigarette case and can engage a cigarette inside said case, the turning drum can be arranged side by side with the cigarette and the recess portion is used to remove the cigarette from said case;

said cigarette case further comprises a push plate, a spring and a pull string, said spring being able to push the push plate so that a cigarette contained inside said case can be pushed, allowing the cigarette to enter into said recess portion of the turning drum for storage, said pull string being fed through a hole in the outside of said case and connected to said push plate;

said revolving device comprises a blocking member for the cigarette, the blocking member is provided on the outside of said cigarette case and is located in a position close to said turning drum;

said lighting device comprises a lighting nozzle, which is located in a position for lighting the cigarette.

2. The automatic cigarette case as recited in claim 1, wherein said turning device consists of a turning drum cover and a driving device, said cover is connected to the cigarette case by a shaft for covering said turning drum, said driving device is provided between the turning drum and the cover.

3. The automatic cigarette case as recited in claim 2, wherein said driving device consists of a gear member, a sector gear plate, a driving block, a turning block and a recovery block, a gear is secured to the shaft of the turning drum, said sector gear plate is provided with two sector gears of different diameters, each of the sector gears are respectively meshed with teeth of the gear member for transmission, said driving block is provided at the cover, said turning block and recovery block are provided at the sector gear plate.

4. The automatic cigarette case as recited in claim 2, wherein said driving device is made of a pulling member driving device, which consists of a pulling member, a driving wheel and a driven wheel, in which the pulling member is provided by long strips which surround the driving wheel and the driven wheel, said driving wheel is secured onto said cover and can be rotated together with said cover, said driven wheel is secured with the turning drum and can be rotated together with said turning drum.

5. The automatic cigarette case as recited in claim 2, wherein said driving device consists of a driving wheel, a driven wheel and an elliptic wheel, said driving wheel is secured to said cover and can be rotated together with said cover, said driven wheel is secured to the turning drum and can be rotated together with the turning drum, said elliptic wheel is connected through an axis to the cigarette case, said elliptic wheel is provided between said driving wheel and said driven wheel and serves as a transmission of rotation between the two wheels.

6. The automatic cigarette case as recited in claim 5, wherein said driving wheel, driven wheel and elliptic wheel are each a toothed wheel.

7. The automatic cigarette case as recited in claim 2, wherein said driving device is a feeding device, which consists of a pin wheel having teeth and a guide member, said pin wheel and said turning drum cover are connected and rotated together, said guide member and said turning drum are connected and rotated together, said pin wheel is provided with a slot which can cooperate with said pin wheel teeth.

8. The automatic cigarette case as recited in claim 7, wherein said turning drum cover is provided with an arc-shaped member, and said guide member is provided with an arc-shaped portion for cooperating with the arc-shaped member.

* * * * *